US008335457B2

(12) United States Patent
Hughes et al.

(10) Patent No.: US 8,335,457 B2
(45) Date of Patent: Dec. 18, 2012

(54) METHODS, SYSTEMS AND APPARATUS FOR SYNCHRONIZING TWO PHOTORECEPTORS WITHOUT EFFECTING IMAGE ON IMAGE QUALITY

(75) Inventors: David A. Hughes, Pittsford, NY (US); Michael B. Monahan, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 370 days.

(21) Appl. No.: 12/752,426

(22) Filed: Apr. 1, 2010

(65) Prior Publication Data

US 2011/0243610 A1 Oct. 6, 2011

(51) Int. Cl.
*G03G 15/00* (2006.01)
*G03G 15/01* (2006.01)

(52) U.S. Cl. ..... 399/160; 399/38; 399/301

(58) Field of Classification Search ..... 399/38, 399/40, 160, 167, 299, 301; 347/116
See application file for complete search history.

(56) References Cited

U.S. PATENT DOCUMENTS

| | | | | |
|---|---|---|---|---|
| 4,837,636 | A | 6/1989 | Daniele et al. | |
| 5,204,620 | A | 4/1993 | Costanza et al. | |
| 5,291,245 | A * | 3/1994 | Charnitski et al. | 399/160 X |
| 6,141,523 | A * | 10/2000 | Bergmann et al. | 399/299 X |
| 6,219,516 | B1 | 4/2001 | Furst et al. | |
| 6,275,244 | B1 | 8/2001 | Omelchenko et al. | |
| 6,300,968 | B1 | 10/2001 | Kerxhalli et al. | |
| 6,456,310 | B1 | 9/2002 | Wallace et al. | |
| 6,909,516 | B1 | 6/2005 | Hoover | |
| 7,245,856 | B2 | 7/2007 | Furst et al. | |
| 7,298,998 | B1 | 11/2007 | Tooker et al. | |
| 7,519,314 | B2 | 4/2009 | Carolan | |
| 2008/0260445 | A1 * | 10/2008 | Costanza et al. | 399/394 |
| 2009/0028614 | A1 | 1/2009 | Kerxhalli et al. | |

OTHER PUBLICATIONS

U.S. Appl. No. 12/477,524, filed Jun. 3, 2009, Kerxhalli et al.

* cited by examiner

*Primary Examiner* — Sandra Brase
(74) *Attorney, Agent, or Firm* — Fay Sharpe LLP

(57) ABSTRACT

Disclosed are image processing methods and systems to control the synchronization of two or more photoreceptor belts associated with an image processing system. According to one exemplary method, the phase error of a slave printing engine photoreceptor belt is controlled by modifying the speed of the slave printing engine photoreceptor belt by an increment which is a function of a predetermined image on image registration tolerance associated with the slave printing engine. Notable, the phase error is controlled while the slave printing engine develops an image on its respective photoreceptor belt.

20 Claims, 8 Drawing Sheets

METHODS, SYSTEMS AND APPARATUS FOR SYNCHRONIZING TWO PHOTORECEPTORS WITHOUT EFFECTING IMAGE ON IMAGE QUALITY

CROSS REFERENCE TO RELATED PATENTS AND APPLICATIONS

U.S. Pat. No. 6,219,516, by Furst et al., entitled: "SYSTEMS AND METHODS FOR REDUCING IMAGE REGISTRATION ERRORS," ISSUED Apr. 17, 2001.

BACKGROUND

The subject embodiment pertains to the art of printing systems and more particularly printing systems including a plurality of printing engines capable of operating in tandem for parallel or sequential printing of job portions. The preferred embodiments especially relate to a system and method for synchronizing relative operating positions of photoreceptor belts within the printing assembly to avoid undesirable belt seam positioning that can diminish system throughput efficiency. More particularly, this disclosure relates to systems and methods in which image registration tolerances in IOI (Image on Image) color output images are maintained while synchronizing the photoreceptor belts associated with a printing system.

Electrophotography, a method of copying or printing documents, is performed by exposing a light image representation of a desired original image onto a substantially uniformly charged photoreceptor substrate, such as a photoreceptor belt. In response to this light image, the photoreceptor discharges to create an electrostatic latent image of the desired original image on the photoreceptor's surface. Developing material, or toner, is then deposited onto the latent image to form a developed image. The developed image is then transferred to an image receiving substrate. The surface of the photoreceptor is then cleaned to remove residual developing material and the surface as recharged by a charging device in preparation for the production of the next image.

Color images can be produced by repeating the above-described recording process once for each differently-colored toner that is used to make a composite color image. For example, in a one-color imaging process, referred to herein as the Recharge, Expose, and Develop, Image (REaD IOI) process, a charged photoreceptor surface is exposed to a light image that represents a first color. The resulting electrostatic latent image is then developed with a first colored toner. The toner is typically of a subtractive primary color, including magenta, yellow, cyan, or black. The charge, expose and develop process is repeated for a second colored toner, then for a third colored toner, and finally for a fourth colored toner. The four differently-colored toners are placed in superimposed registration on the photoreceptor so that a desired composite color image results. That composite color image is then transferred and fused onto an image receiving substrate.

Printing engines utilizing photoreceptor belts, as opposed to drums, must avoid using the portion of the belt comprising the seam because the seam, if used to store any image data, can mar the output image. In most engine printing systems, paper feeding systems will detect seam position to avoid lining up the paper with the seam. When such avoidance requires delaying the printing operation for the time period of printing a single page, such a wait is referred to as "skipping a pitch" and has a noticeable negative consequence on printing systems throughput efficiency. Adjusting the feed of the paper to assure avoidance of the seam is normally all that is needed in single print engine systems and is usually successful enough so that a pitch is hardly ever skipped.

A special problem exists in multiple print engine systems where a first printing engine (image output terminal or "IOT") can be a presequential feeder to a second IOT. Of importance is that the second IOT be synchronized to the first IOT, i.e., that the second photoreceptor belt seam is synchronized to the first photoreceptor belt seam to avoid the pitch skipping problems.

When such parallel printing assemblies are initially constructed, it is intended that the respective photoreceptor belts be of the same size (length) and that the motor speed for operating the belts of the IOTs are identical. In such cases, initial calibration is intended to avoid having to adjust the relative positions or operating speeds of the respective engines during operation, or that the feeding system can adjust positions of the documents during input to each engine to accommodate any throughput problems that may arise.

It is an operational objective that there is no delay in paper feed through the system so that throughput can always be maximized. Unfortunately the practical reality is that no two photoreceptor belts are exactly the same size, nor are their respective motors capable of running at exactly the same speed. The respective differences may be quite small, but over time, and the production of many print documents, the respective belts can become so out of synchronization that the conventional paper feed adjustment systems may not be capable of accommodating the phase feed differences and a pitch may have to be skipped.

INCORPORATION BY REFERENCE

U.S. Pat. No. 7,519,314, by Kevin M. Carolan, entitled: "MULTIPLE IOT PHOTORECEPTOR BELT SEAM SYNCHRONIZATION," issued Apr. 14, 2009, is totally incorporated herein in its entirety.

BRIEF DESCRIPTION

In one embodiment of this disclosure, described is a method of controlling the synchronization of the photoreceptor belt seams associated with a multi-engine printing system including a first photoreceptor belt associated with a first printing engine and a second photoreceptor belt associated with a second IOI (Image on Image) printing engine, the method comprising a) measuring a speed and phase of the first photoreceptor belt relative to a photoreceptor belt seam associated with the first photoreceptor belt; b) controlling a speed and phase of the second photoreceptor belt to substantially equal the measured speed of the first photoreceptor belt and the phase adjusted to substantially equal the measured phase of the first photoreceptor belt plus an offset associated with the travel distance of a media sheet from the first printing engine to the second printing engine, wherein the speed and phase of the second photoreceptor belt is controlled while the second printing engine is not developing an image on the second photoreceptor belt; c) developing one or more images on the second photoreceptor belt, the second photoreceptor belt controlled to operate at the measured speed of the first photoreceptor belt in step a); and d) maintaining a phase error of the second photoreceptor belt relative to the first photoreceptor belt as a function of a predetermined IOI registration tolerance associated with the second printing engine, the speed of the second photoreceptor being adjusted to the phase error while an image is being developed on the second photoreceptor belt.

In another embodiment of this disclosure, an image processing system is disclosed including two or more printing engines for forming an image on an image receiving substrate comprising a first printing engine including a first photoreceptor belt; a second IOI printing engine operatively connected to the first printing engine, the second printing engine including a second photoreceptor belt; and a controller operatively connected to the first and second printing engines, the controller configured to execute a method of controlling the synchronization of the first and second photoreceptor belts, the method comprising a) measuring a speed and phase of the first photoreceptor belt relative to a photoreceptor belt seam associated with the first photoreceptor belt; b) controlling a speed and phase of the second photoreceptor belt to substantially equal the measured speed of the first photoreceptor belt and the phase adjusted to substantially equal the measured phase of the first photoreceptor belt plus an offset associated with the travel distance of a media sheet from the first printing engine to the second printing engine, wherein the speed and phase of the second photoreceptor belt is controlled while the second printing engine is not developing an image on the second photoreceptor belt; c) developing one or more images on the second photoreceptor belt, the second photoreceptor belt controlled to operate at the measured speed of the first photoreceptor belt in step a); and d) maintaining a phase error of the second photoreceptor belt relative to the first photoreceptor belt as a function of a predetermined IOI registration tolerance associated with the second printing engine, the speed of the second photoreceptor being adjusted to the phase error while an image is being developed on the second photoreceptor belt.

In still another embodiment of this disclosure, described is a computer program product that when executed causes a controller to execute instructions to perform a method comprising a) measuring a speed and phase of the first photoreceptor belt relative to a photoreceptor belt seam associated with the first photoreceptor belt; b) controlling a speed and phase of the second photoreceptor belt to substantially equal the measured speed of the first photoreceptor belt and the phase adjusted to substantially equal the measured phase of the first photoreceptor belt plus an offset associated with the travel distance of a media sheet from the first printing engine to the second printing engine, wherein the speed and phase of the second photoreceptor belt is controlled while the second printing engine is not developing an image on the second photoreceptor belt; c) developing one or more images on the second photoreceptor belt, the second photoreceptor belt controlled to operate at the measured speed of the first photoreceptor belt in step a); and d) maintaining a phase error of the second photoreceptor belt relative to the first photoreceptor belt as a function of a predetermined IOI registration tolerance associated with the second printing engine, the speed of the second photoreceptor being adjusted to the phase error while an image is being developed on the second photoreceptor belt.

DETAILED DESCRIPTION

Figure 1:
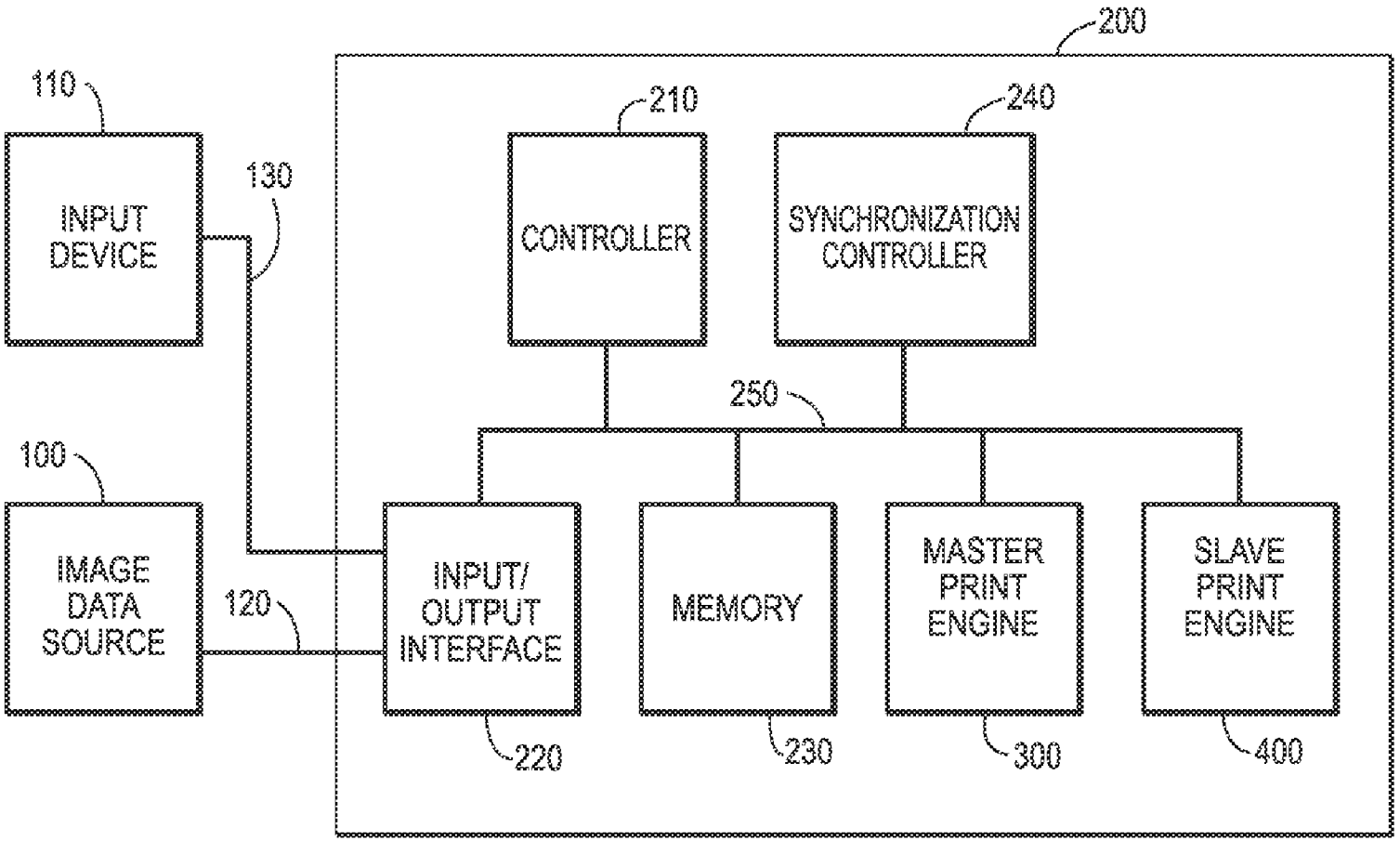
FIG. 1 shows one exemplary embodiment of an image processing system according to this disclosure.

Tandem print engine systems include two print engines arranged in a series configuration. Each print engine includes a photoreceptor belt and imagers disposed at spaced positions along the length, i.e., the process direction, of the photoreceptor belt. Each imager comprises an image source that exposes the photoreceptor belt. Typically, the image source includes a light emitting device that emits a light beam that is moved laterally across the photoreceptor belt to expose the photoreceptor belt to create a latent electrostatic image on the photoreceptor belt. Each latent image is then developed as outlined above. Image receiving substrates, such as sheets of copy paper, are fed in a time-controlled manner to the print engines. The first print engine transfers its developed image to the simplex side of the image receiving substrate. The image receiving substrate is then inverted and presented to the second print engine. The second print engine then transfers its developed image to the duplex side of the image receiving substrate.

Each photoreceptor belt of the first and second print engines includes a seam where opposed end portions of the photoreceptor belt are joined together. The photoreceptor belts include pitch regions in which images can be satisfactorily formed. Images cannot be satisfactorily formed at the seams, because the images formed at seams are normally defective. Accordingly, it is important to control the locations of the seams of both of the first and second photoreceptor belts during print runs, to prevent forming images at the seams, and to ensure that images are formed only in the pitch regions.

In a tandem print engine configuration, there are several technology issues involved with synchronizing two photoreceptor belt modules of two separate print engines in a manner that does not negatively impact the registration of either module. If the periods of revolution of the two photoreceptor belts are not matched, then the positions of the seams will also not be synchronized. The photoreceptor belts can have different lengths and, accordingly, in such configurations must rotate at different velocities (speeds) to maintain the same periods of revolution. If the periods of revolution are not synchronized appropriately to each other or with imager velocities, image registration errors will occur during printing. The image registration errors can be characterized as 1) simplex to duplex image registration errors if the photoreceptor and imager velocities for each print engine are not matched appropriately, or 2) image-on-image (IOI) registration errors from changes in the photoreceptor velocity or imager velocity while printing is occurring. Image-on-image registration errors occur during the building of color images on the photoreceptor belts. If, during stacking the multiple color separation layers of a color image on each other, the images are not aligned with each other, then image registration errors between the color separation layers will occur. These registration errors produce print defects such as color shifts and trapping errors.

Registration errors are caused generally by the motion quality of the photoreceptor belts and the manner that the imagers form the latent images on the photoreceptor belts. Regarding the motion quality of the photoreceptor belts, image registration errors can be caused by changes in the photoreceptor belt velocity, making it difficult to form images smoothly and to align lead edges of the images on the photoreceptor belt. Velocity changes can occur due to various different factors, including errors of the drive motor, errors in roller velocities and diameters, belt length changes during operation due to tension and thermal effects, and normal roller and belt tolerances.

Factors that can cause registration errors in the manner in which the imagers form the latent images, include errors in the lateral scan velocity, i.e., the exposure velocity, of the image sources across the photoreceptor belt, the scanning start and end points of the scanning light beam, and the length of the scan lines.

In simplex (single print engine) configurations, the image registration can be set up off-line. Thus, adjustments can be made at times when print runs are not being performed. In such configurations, the photoreceptor belt velocity is maintained as constant as possible to minimize registration errors. In addition, the imagers are set to a specific reference and their velocity is tightly maintained. If, during the course of producing an image, the velocity of the photoreceptor belt and the scan velocity of the image sources of the imager vary with respect to each other, either in position or velocity, then registration errors will occur.

Simplex print engine systems can include monitoring systems for measuring and compensating for image registration errors. Simplex print engine systems can calibrate themselves to the characteristics of the photoreceptor belt to achieve good image alignment for color images. If the photoreceptor belt rims either too fast or too slow, the scan velocity of the image sources can be automatically adjusted to counter the change in the photoreceptor belt velocity. As long as the photoreceptor belt velocity is maintained substantially constant, then only small image registration errors occur due to the self-correcting measures that are taken by the system.

For tandem print engine configurations, however, the synchronization requirements for the two print engines require that the photoreceptor belt velocity of the downstream print engine, i.e., the "slave print engine," must be adjusted to keep it timed with the period of revolution of the photoreceptor belt of the upstream print engine, i.e., the "master print engine," Otherwise, it is not possible to control the locations of the seams of the photoreceptor belts of the master and slave print engines. As explained, it is important to control the seams to prevent the formation of images on the seams.

In tandem print engine configurations, various factors can cause the two photoreceptor belts to be out of synchronization with each other. Namely, the photoreceptor belt velocities and lengths can change over time due to changes in the roller diameters, encoder diameters and thermal effects. The belt length can be out of specification originally and can also vary during operation due to stretch caused by tension and thermal effects. The encoder roller that measures the belt velocity can change in diameter due to thermal effects. Consequently, the photoreceptor belts can run at different periods of revolution.

In order to synchronize the photoreceptor belts of the master and slave print engines, the photoreceptor belt velocity of the slave print engine can be changed. In making such adjustments for the slave print engine, the slave print engine should be adjusted on-line. Otherwise, the productivity of the tandem print engine is decreased.

Because it is not necessary to take the slave print engine off-line periodically to make such adjustments, the systems and methods of this disclosure can improve productivity in tandem print engine configurations. The systems and methods of this disclosure also avoid the need to introduce additionally complex machine communications and scheduling techniques that would be needed to be able to make adjustments off-line in tandem print engine configurations.

As previously stated, a tandem IOI color printing engine system includes two photoreceptors (P/Rs), each having a seam zone in which imaging should not take place. The first P/R makes use of a seam hole so that images are not scheduled through the seam zone. The second P/R also needs to avoid printing in its seam zone as it receives paper from the first P/R. Therefore, the second P/R is synchronized to the first P/R plus some offset.

This synchronization needs to be maintained throughout a print job since the printing engines may have slightly different dimensions causing the phase to drift. Moreover, the synchronization needs to be maintained without effecting the image on image specifications associated with the printing engines.

Because there are four imaging stations along the belt, the speed changes take place while imaging occurs.

The synchronization process according to this disclosure and the exemplary embodiments herein, includes 3 steps:

(1) P/R Module 2 (slave) measures and matches the velocity of P/R Module 1 (master).

(2) P/R Module 2 (slave) runs a coarse synchronization routine to match the phase of Module 1 (master) plus some offset.

(3) P/R Module 2 (slave) maintains synchronization while printing without effecting image on image quality.

FIG. 1 shows one exemplary embodiment of an image processing apparatus incorporating image registration control systems in accordance with this disclosure. As shown, an image data source 100 and an input device 110 are connected to the image processing apparatus 200 over links 120 and 130, respectively. The image data source 100 can be a digital camera, a scanner, or a locally or remotely located computer, or any other known or later developed device that is capable of generating electronic image data. Similarly, the image data source 100 can be any suitable device that stores and/or transmits electronic image data, such as a client or a server of a network. The image data source 100 can be integrated with the image processing apparatus 200, as in a printing system having an integrated scanner, or the image data source 100 can be connected to the image processing apparatus 200 over a connection device, such as a modem, a local area network, a wide area network, an intranet, the Internet, any other distributed processing network, or any other known or later developed connection device.

It should also be appreciated that, while the electronic image data can be generated at the time of printing an image from electronic image data, the electronic image data can be generated at any time prior to the printing. Moreover, the electronic image data need not be generated from an original physical document, but can optionally be created from scratch electronically. The image data source 100 is thus any known or later developed device that is capable of supplying electronic image data over the link 120 to the image processing apparatus 200. The link 120 can thus be any known or later developed system or device for transmitting the electronic image data from the image data source 100 to the image processing apparatus 200.

The input device 110 can be any known or later developed device for providing control information from a user to the image processing apparatus 200. Thus, the input device 110 can be a control panel of the image processing apparatus, or can be a control program executing on a locally or remotely located general purpose computer, or the like. As with the link 120 described above, the link 130 can be any known or later developed device for transmitting control signals and data input using the input device 110 from the input device 110 to the image processing apparatus 200.

Figure 2:
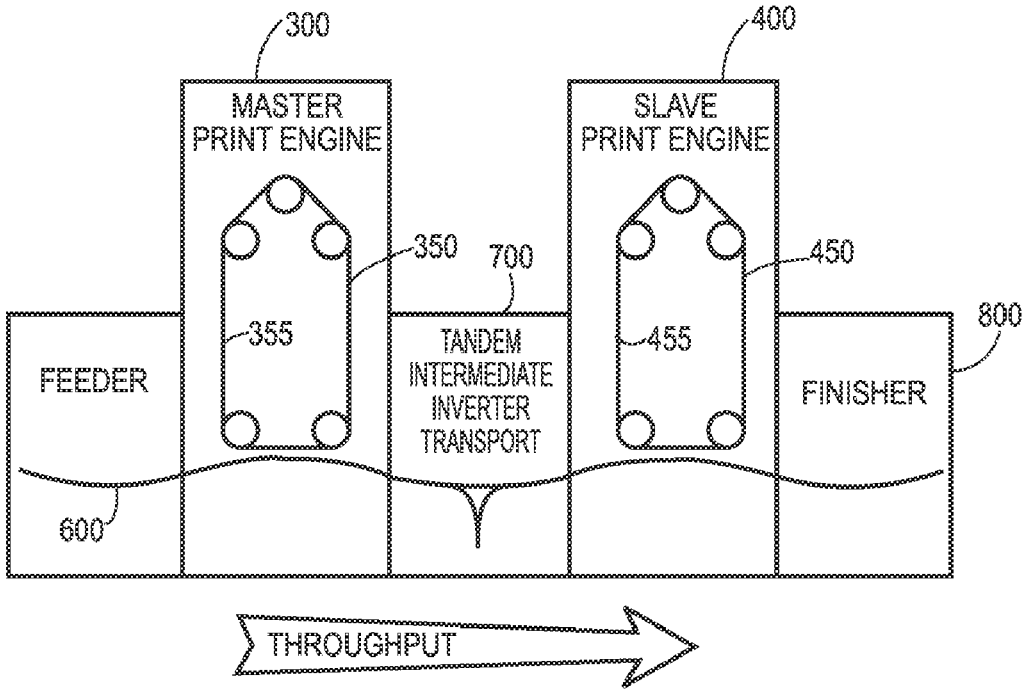
FIG. 2 schematically illustrates a tandem print engine system according to an exemplary embodiment of this disclosure.

As shown in FIGS. 1 and 2, in one exemplary embodiment, the image processing apparatus 200 includes a controller 210, an input/output interface 220, a memory 230, a master print engine 300, a slave print engine 400, and a synchronization controller 240, each of which is interconnected by a control and/or data bus 250. The links 120 and 130 from the image data source 100 and the input device 110, respectively, are connected to the input/output interface 220. The electronic image data from the image data source 100, and any control and/or data signals from the input device 110, are input through the input interface, and, under control of the controller 210, are stored in the memory 230 and/or provided to the controller 210.

The memory 230 preferably has at least an alterable portion and may include a fixed portion. The alterable portion of the memory 230 can be implemented using static or dynamic RAM, a floppy disk and disk drive, a hard disk and disk drive, flash memory, or any other known or later developed alterable volatile or non-volatile memory device. If the memory 230 includes a fixed portion, the fixed portion can be implemented using a ROM, a PROM, an EPROM, and EEPROM, a CD-ROM and disk drive, a writable optical disk and disk drive, or any other known or later developed fixed memory device.

FIG. 2 illustrates one exemplary tandem print engine configuration of the image processing apparatus 200. As shown, the tandem print engine includes the master print engine 300 and the slave print engine 400 arranged in a series configuration. During a print run of the image processing apparatus 200, a feeder 600 feeds an image receiving substrate, such as copy paper, to the master print engine 300. The image receiving substrate has a simplex side and a duplex side. The master print engine 300 prints a colored image on the simplex side of the image receiving substrate. The image receiving substrate is then inverted by an inverter transport device 700, disposed between the master print engine 300 and the slave print engine 400, and transported to the slave print engine 400. The slave print engine 400 prints a colored image on the duplex side of the image receiving substrate. The image receiving substrate is then transported to a finisher device 800.

Figure 4:
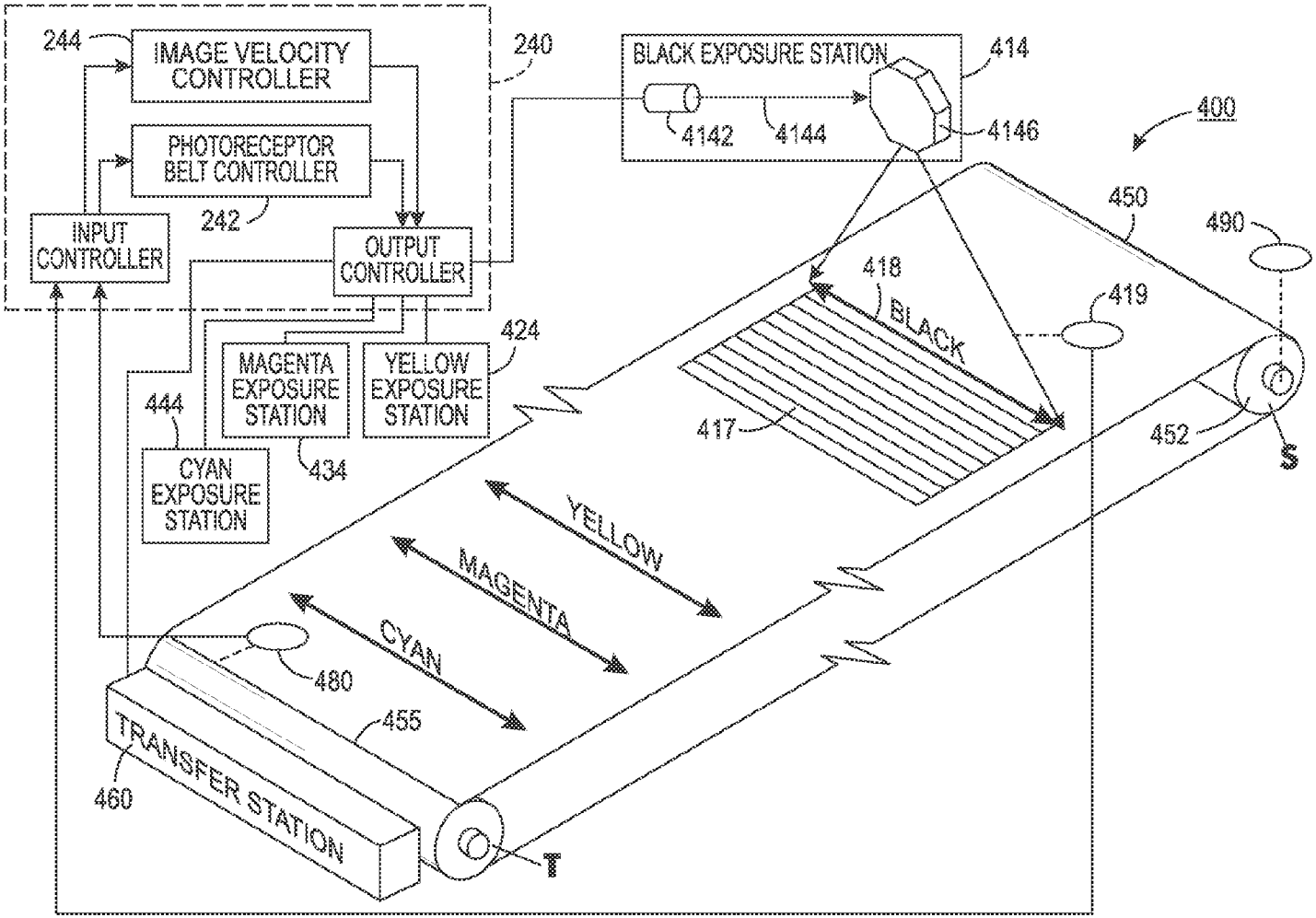
FIG. 4 shows one exemplary embodiment of an IOI photoreceptor belt.

As shown in FIG. 2, the master print engine 300 includes a photoreceptor that comprises a master photoreceptor belt 350 and the slave print engine 400 includes a photoreceptor that comprises a slave photoreceptor belt 450. As shown in FIGS. 2 and 4, the master photoreceptor belt 350 has a seam 355 and the slave photoreceptor belt 450 has a seam 455. The master photoreceptor belt 350 and the slave photoreceptor belt 450 each rotate at a selected period of revolution, i.e., the amount of time for the belt to make one complete revolution. The synchronization controller 240 adjusts the velocity of the slave photoreceptor belt 450.

Figure 3:
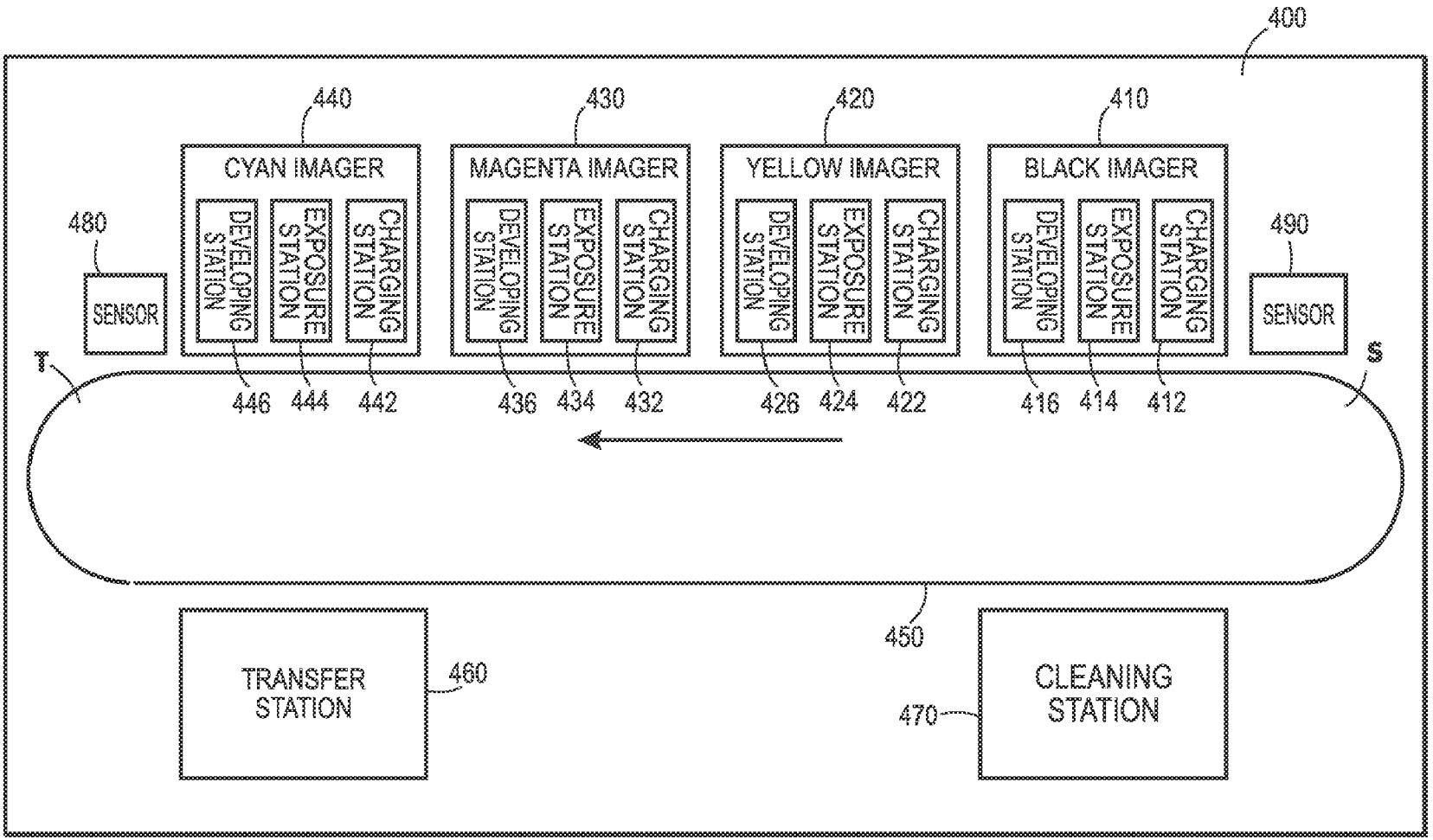
FIG. 3 shows one exemplary embodiment of an IOI printing engine incorporating a control system for synchronizing two photoreceptor belts according to this disclosure.

FIG. 3 shows one exemplary embodiment of the slave print engine 400 according to this invention. The slave print engine 400 and the master print engine 300 can have the same configuration. Accordingly, only the slave print engine 400 will be described in detail. As shown in FIG. 3, the slave print engine 400 includes the color imagers 410, 420, 430 and 440, the slave photoreceptor belt 450, an image transfer station 460, a cleaning station 470, a photoreceptor belt seam sensor 480, and a photoreceptor belt velocity sensor 490.

As shown in FIG. 3, the color imagers 410, 420, 430 and 440 are located along the process direction of the slave photoreceptor belt 450 between a steering end S and a transfer end T of the slave photoreceptor belt 450. Each of the color imagers 410, 420, 430 and 440 includes a respective charging station 412, 422, 432 and 442; an exposure station 414, 424, 434 and 444; and a developing station 416, 426, 436 and 446. In each of the imagers 410, 420, 430 and 440, the respective charging station 412, 422, 432 and 442, uniformly charges the slave photoreceptor belt 450 in preparation for forming a latent electrostatic image. In each of the imagers 410, 420, 430 and 440, the respective exposure station 414, 424, 434 and 444 exposes the uniformly charged slave photoreceptor belt 450 to form a latent electrostatic image. Then, in each of the imagers 410, 420, 430 and 440, the respective developing station 416, 426, 436 and 446 applies a toner of a different color to develop the corresponding latent electrostatic image formed on the slave photoreceptor belt 450 using the differently-colored toners.

In the illustrated embodiment, the imager 410 forms a black color separation image, the imager 420 forms a yellow color separation image, the imager 430 forms a magenta color separation image, and the imager 440 forms a cyan color separation. It will be appreciated that the imagers 410-440 can alternatively use other colors.

It should be appreciated that each of the exposure stations of the respective master and slave print engines 300 and 400 can be implemented using any known or later developed device for forming an electrostatic latent image on the respective master and slave photoreceptor belts 350 and 450. For example, the image forming device can be a rotating polygon raster output scanner (ROS), a full width printbar containing light emitting diodes (LEDs), laser diodes, organic light emitting diodes or the like. When the exposure stations 412-442 are implemented using rotating polygon raster output scanners, the raster output scanners of the respective exposure stations scan laterally across the master and slave photoreceptor belts 350 and 450 at a selected scan velocity that is related to the belt velocity, to achieve a proper image size on the image receiving substrate.

As explained above, during a print run, the imagers 410, 420, 430 and 440 each form a different color separation image on the slave photoreceptor belt 450, and the color separation images are built up on top of each other to form a composite color image. If the distinct color separation images are not aligned with other on the slave photoreceptor belt 450, then image registration errors, i.e., misregistration, will occur due to the image registration offset in the colored image.

The photoreceptor belt seam sensor 480 senses the seam 455 of the slave photoreceptor belt 450. The photoreceptor belt velocity sensor 490 senses the velocity of the slave photoreceptor belt 450. The photoreceptor belt velocity sensor 490 senses, for example, the speed of rotation of a drive roller 452 that drives the slave photoreceptor belt 450. By changing the rotation speed of the drive roller 452, the velocity and phase and, thus the period of revolution of the slave photoreceptor belt 450 can be adjusted.

FIG. 4 shows in greater detail one exemplary embodiment of the slave print engine 400 shown in FIGS. 1 and 3. In this exemplary embodiment of the slave print engine 400, each of the exposure stations 414, 424, 434 and 444 of the respective imagers 410, 420, 430 and 440 comprises a raster output scanner to expose the slave photoreceptor belt 450. In FIG. 4, only the raster output scanner of the black exposure station 414 is shown in detail. The raster output scanners of the other exposure stations will be identical. As shown in FIG. 4, the exposure station 414 includes an image source 4142 that emits at least one light beam 4144. Each light beam 4144 emitted by the image source 4142 is imaged onto a rotating polygon mirror 4146 by input optics (not shown). Each light beam 4144 reflected from the rotating polygon mirror 4146 is imaged onto the slave photoreceptor belt 450 using a set of output optics (not shown).

As shown in FIG. 4, a black color separation image 417 formed on the slave photoreceptor belt 450 comprises a plurality of lateral scanlines 418. Each scanline 418 has a beginning point and an ending point. The color separation images also comprise such lateral scanlines. The beginning point, or "start of scan" point, is the point at which the current facet of the rotating polygon mirror 4146 directs each of the one or more light beams 4144 onto an appropriate portion of the slave photoreceptor belt 450 such that image data can be recorded. The scan velocity detector 419 detects the amount of time for the scanlines 418 of the color separation images 417 to be formed on the slave photoreceptor belt 450.

As shown in FIG. 4, in one exemplary embodiment, the synchronization controller 240 includes a photoreceptor belt velocity controller 242 and an imager velocity controller 244, which are connected to the slave photoreceptor belt 450 and the imagers 410-440, respectively, of the slave print engine 400 over the control and/or data bus 250. The synchronization controller 240 adjusts the velocity of the slave photoreceptor belt 450 and the velocities of the imagers 410-440 of the slave print engine while the slave print engine 400 is on-line. Consequently, the systems and methods of this disclosure can overcome problems associated with making the photoreceptor belt velocity adjustments while the slave print engine 400 is on-line. As a result, color image registration errors in the slave print engine 400 can be reduced, and problems associated with taking the slave print engine 400 off-line to make such corrections can be avoided.

FIG. 5 illustrates

Figure 5:
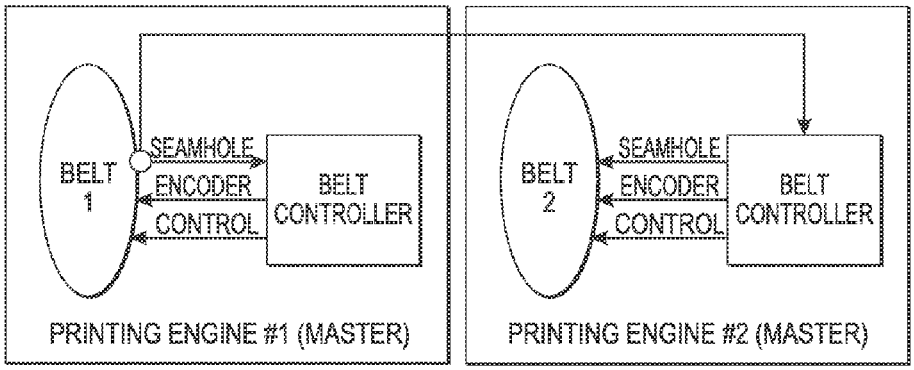
FIG. 5 schematically illustrates a photoreceptor belt controller associated with a slave print engine according to an exemplary embodiment of this disclosure.
Figure 6:
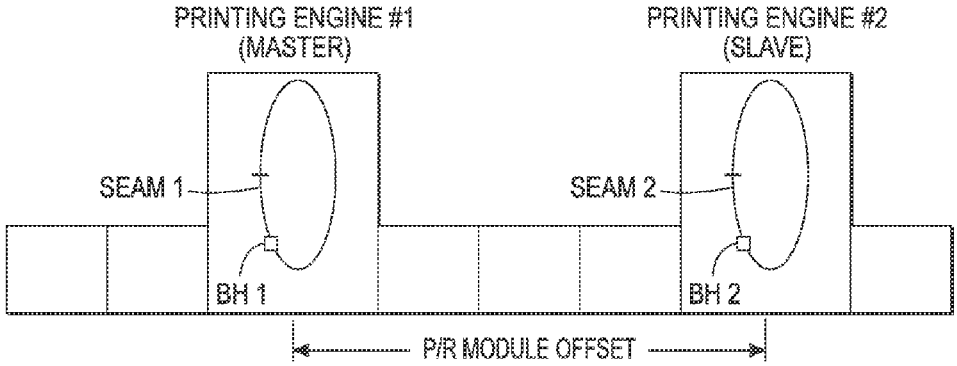
FIG. 6 schematically illustrates the relative relationship of photoreceptor belt position on a tandem print engine system according to an exemplary embodiment of this disclosure.

Step 1: P/R Module 2 Measures the Velocity of P/R Module 1:

With reference to FIGS. 5 and 6, a seam hole sensor signal from P/R Module 1 is brought into P/R Module 2 control board into a generic input to a microprocessor that is monitored every 800 usec. P/R Module 2 then measures the period of the P/R belt of printing engine 1 using the seam hole sensor signal. P/R Module 2 P/R then measures its own length by counting encoders (see FIGS. 7-9) for one rev of the P/R belt associated with printing engine 2. It can then match the speed of module 1 with the following equation:

Module 2 total encoders/Module 1 period=Module 2 encoders/sec=desired speed of Module 2.

Step 2: P/R Module 2 Runs Coarse Sync. Routine to Match the Phase of P/R Module 1 Plus Some Offset:

Module 2 finds the phase error between the P/R belts:

P/R Module 2 Seam Hole Time(*BH*2)−P/R Module 1 Seam Hole(*BH*1)Time−P/R Module Offset=Phase Error, where units are P/R module 2 encoder counts.

The phase error is removed over several P/R belt revolutions by increasing or decreasing the speed of P/R belt 2 associated with the second printing engine. These speed changes occur while the machine is not printing (e.g. offline) so coarse speed changes can be used to quickly bring the master slave P/R belts into phase over a few belt revolutions. P/R belt synchronization is declared when a relatively small encoder error, i.e., phase error, is achieved. For example, and for purposes of this disclosure, value is 'Min Error For Sync' (e.g., less than 6 encoder counts. Notably, according to one exemplary printing engine, there are roughly 18666 encoders per belt revolution).

Step 3: P/R Module 2 Maintains Synchronization of the P/R Belts without Effecting Image on Image Quality:

Once the coarse synchronization of Step 2 is complete, P/R Module 2 will control the slave P/R belt to run at the speed calculated in step 1, Sync Base Speed, and printing on the slave printing engine may begin/continue. However, the accuracy of Sync Base Speed calculation has limitations in its precision which can immediately cause the phase error between the first and second P/R belts to increase. Therefore, two issues need to be resolved:

1) find the optimal speed for the P/R belt associated with Module 2 (slave) that matches the speed of the P/R belt associated with Module 1 (master).

2) bring the phase error back to a nominal value.

Since the slave printing engine is now producing printed images, both the first and second issues must be resolved without sacrificing the image on image registration tolerances associated with printing a quality image on the P/R belt. In other words, the P/R belt speed of the slave printing engine must be tightly controlled. According to one exemplary embodiment, the image on image spec is 80 microns.

The optimal value for Sync Base Speed is found by the process described below. This process also brings the phase error back to a nominal valve.

The algorithm described below adjusts the speed of P/R module 2 in 1/32 Hz increments, at most once per revolution of the P/R belt. This speed change is small enough that the image on image quality of the slave printing engine is not affected to a degree that is perceivable by a viewer of the printed image. The drawback of the small speed changes is that the phase of P/R BH2 can drift while issues 1 and 2 above are dialed in.

To account for phase drift, the value of Min Error For Sync will be raised to a large number (for example 60 encoders) to allow the phase to drift without the system indicating a P/R belt synchronization fault. The threshold for Min Error For Sync is determined by how much phase drift can be tolerated by the slave printing engine without impacting the overall quality of the P/R belt image layout or registration on the P/R belt associated with Module 2.

The incremental speed adjustments are made as a function of the phase error and whether or not the phase error is increasing. According to one exemplary embodiment, the phase error is run through a low pass filter to help with compensation.

Regarding the velocity of P/R module 2 (Mod 2 Speed), this P/R belt will always run at one of the following:

Sync Base Speed;

Sync Base Speed+incremental speed change (1/32 Hz);

Sync Base Speed−incremental speed change (1/32 Hz) (speed changes from (Base Speed+1/32) to (Base Speed−1/32) are not allowed as that is effectively a 1/16 Hz speed change which would produce unacceptable IOI registered images);

where Sync Base Speed will change if the phase error is increasing.

Module 2 Speed is determined as follows:

```
IF (Phase Err < −Max Err)        Then (Negative error that is outside
                                 threshold → slow down)
                 Mod 2 Speed = Sync Base Speed − 1/32.
IF (Phase Err > Max Err)         Then (Positive error that is outside
                                 threshold → speed up)
                 Mod 2 Speed = Sync Base Speed + 1/32
Else                             (Error is small → don't adjust speed)
                 Mod 2 Speed = Sync Base Speed
```

Sync Base Speed is determined as follows:

```
If (Phase Err < −MaxNominal) AND                (Neg Err outside
(PhaseErrDerivative < 0)                        threshold and
                                                getting larger
    Sync Base Speed = Sync Base Speed − 1/32        →dec
                                                Base Speed)
If (Phase Err > MaxNominal) AND                 (Pos Err outside
(PhaseErrDerivative > 0                         of threshold and
                                                getting larger
    Sync Base Speed = Sync Base Speed + 1/32        → inc Base
                                                Speed)
Else Sync Base Speed = Sync Base Speed          (Error is within
                                                threshold
                                                    → don't
                                                adjust Base
                                                Speed)
```

Figure 7:
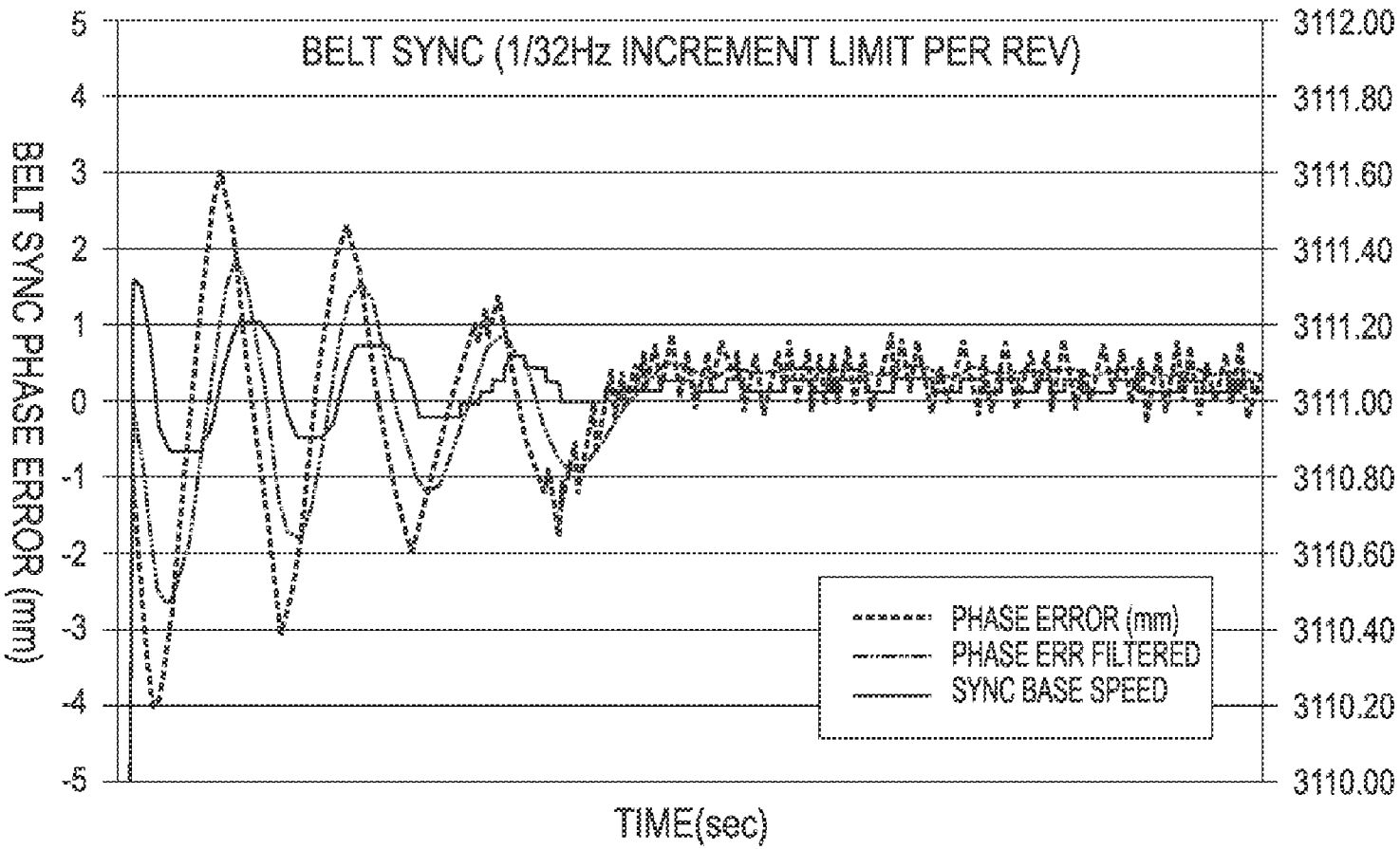
FIG. 7 illustrates phase error and optimal sync base speed according to one exemplary embodiment of this disclosure.

The above process requires many belt revolutions to find the optimal speed and bring phase of the slave P/R belt back to a nominal value. It is therefore not feasible to do this prior to actively printing since cycle up time is already delayed with the coarse adjustment routine. In FIG. 7, a chart shows how phase error and optimal Sync Base Speed (Des Hz) can be dialed in over many belt revolutions.

The process described hereto can achieve and maintain belt synchronization without sacrificing overall image quality and any tandem machine requiring high image quality with multiple image stations can make use of the invention discussed hereto.

Figure 8:
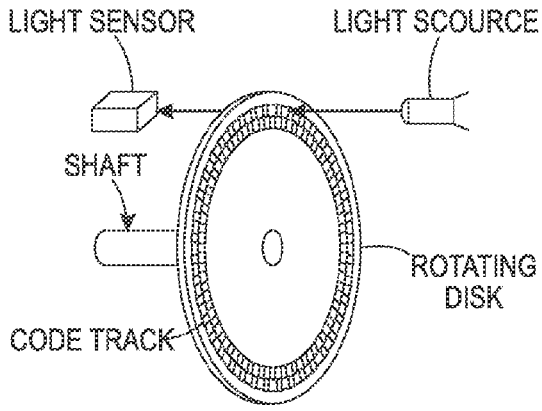
FIG. 8 schematically illustrates an exemplary encoder arrangement according to this disclosure.
Figure 9:
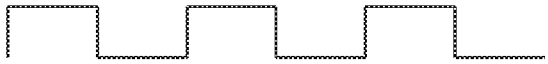
FIG. 9 illustrates the output of the encoder arrangement of FIG. 5.
Figure 10:
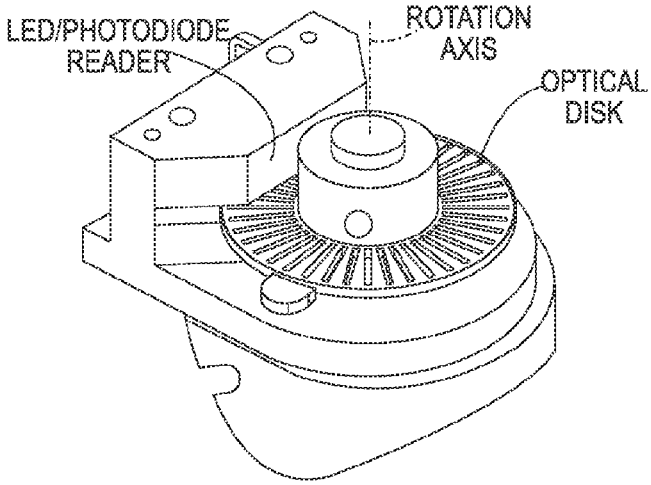
FIG. 10 illustrates one exemplary embodiment of an optical encoder according to this disclosure.

With reference to FIGS. 8-10, illustrated are various aspects of an encoder arrangement as discussed above for determining a phase error according to an exemplary embodiment of this disclosure.

FIG. 8 schematically illustrates an encoder arrangement including a rotating disk operatively connected to a shaft. The rotating disk includes a Code Track which is a plurality of equally spaced holes/partitions to allow/disallow light from a light source to pass through the rotating disk to a light sensor. An example of the output of the encoder arrangement of FIG. 8 is shown in FIG. 9, which is a pulse train, the pulse train being correlated to the distance the P/R has traveled. This distance can then be used, as a function of time, to calculate a P/R revolution period and/or speed.

FIG. 9 illustrates one example of an encoder arrangement which can be used with a P/R belt according to this disclosure.

Figure 11:
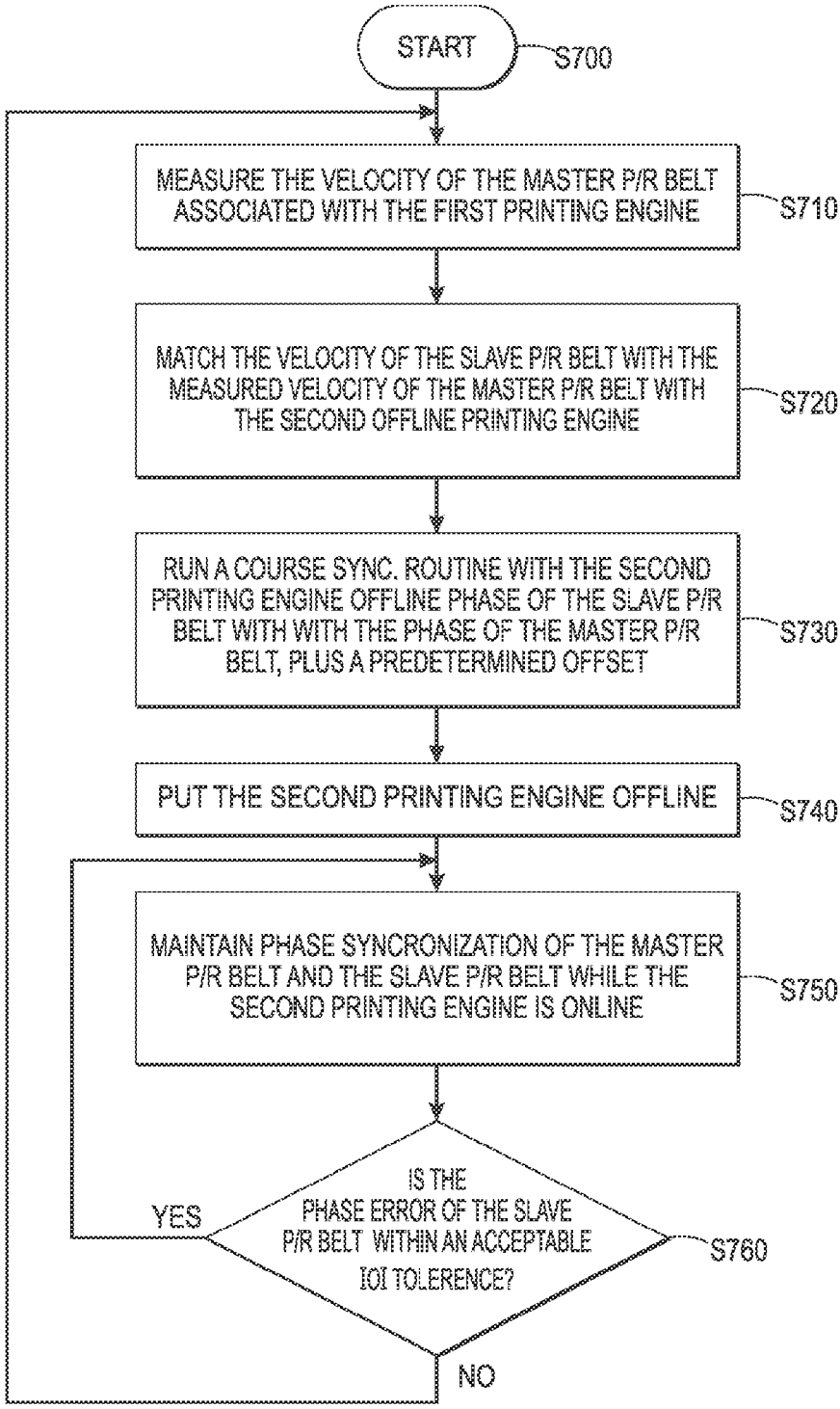
FIG. 11 is a flow chart illustrating one exemplary embodiment of a photoreceptor control method according to this disclosure.

FIG. 11 is a flowchart, Steps S700, S710, S720, S730, S740, S750 and S760 providing another description of the control algorithm/process previously described.

As shown in FIG. 2, the image processing apparatus 200 is preferably implemented on a programmed general purpose computer. However, the image processing apparatus 200 can also be implemented on a special purpose computer, a programmed microprocessor or microcontroller and peripheral integrated circuit elements, an ASIC or other integrated circuit, a digital signal processor, a hardwired electronic or logic circuit such as a discrete element circuit, a programmable logic device such as a PLD, PLA, FPGA or PAL, or the like. In general, any device, which is capable of implementing the finite state machine that is in turn capable of implementing the flowcharts shown in FIG. 11 and/or described in this disclosure, can be used to implement the image processing apparatus.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method of controlling the synchronization of the photoreceptor belt seams associated with a multi-engine printing system including a first photoreceptor belt associated with a first printing engine and a second photoreceptor belt associated with a second IOI (Image on Image) printing engine, the method comprising:

a) measuring a speed and phase of the first photoreceptor belt relative to a photoreceptor belt seam associated with the first photoreceptor belt;

b) controlling a speed and phase of the second photoreceptor belt to substantially equal the measured speed of the first photoreceptor belt and the phase adjusted to substantially equal the measured phase of the first photoreceptor belt plus an offset associated with the travel distance of a media sheet from the first printing engine to the second printing engine, wherein the speed and phase of the second photoreceptor belt is controlled while the second printing engine is not developing an image on the second photoreceptor belt;

c) developing one or more images on the second photoreceptor belt, the second photoreceptor belt controlled to operate at the measured speed of the first photoreceptor belt in step a); and d) maintaining a phase error of the second photoreceptor belt relative to the first photoreceptor belt as a function of a predetermined IOI registration tolerance associated with the second printing engine, the speed of the second photoreceptor being adjusted to the phase error while an image is being developed on the second photoreceptor belt.

2. The method according to claim 1, step d), further comprising:

adjusting the speed of the second photoreceptor belt no more than once per revolution of the photoreceptor belt by an increment associated with an acceptable IOI registration error.

3. The method according to claim 2, wherein the increment is in the range of 1/64 Hz-1/16 Hz.

4. The method according to claim 2, step d) further comprising:

adjusting the speed of the second photoreceptor belt incrementally as a function of the phase error associated with the second photoreceptor belt, relative to the first photoreceptor belt.

5. The method according to claim 4, step d), further comprising:

adjusting the speed of the second photoreceptor belt incrementally as a function of the phase error and derivative of the phase error associated with the second photoreceptor belt relative to the first photoreceptor belt.

6. The method according to claim 5, step d) further comprising:

processing the phase error through a low pass filter.

7. The method according to claim 1, step d) comprising:

d1) measuring a phase error of the second photoreceptor belt relative to the first photoreceptor belt;

d2) if the phase error is less than a negative threshold value, then decreasing the speed of the second photoreceptor belt by a predetermined increment associated with maintaining the predetermined IOI registration tolerance;

d3) if the phase error is greater than a positive threshold value, then increasing the speed of the second photoreceptor belt by the predetermined increment associated with maintaining the predetermined IOI registration tolerance; and d4) if the phase error is greater than or equal to the negative threshold value, and less than or equal to the positive threshold value, then maintaining the speed of the second photoreceptor belt at the measured speed of the first photoreceptor belt in step a).

8. The method according to claim 7, step d) further comprising:

measuring or calculating the derivative of the phase error of the second photoreceptor belt;

determining an optimal speed of the second photoreceptor belt as a function of the measured speed of the first photoreceptor belt in step a) and the derivative of the phase error; and adjusting the steady state speed of the second photoreceptor belt to the optimal value, wherein for purposes of step d1)-d4), the optimal speed is treated as the measured speed of the first photoreceptor belt in step a).

9. An image processing system including two or more printing engines for forming an image on an image receiving substrate comprising:

a first printing engine including a first photoreceptor belt;

a second IOI printing engine operatively connected to the first printing engine, the second printing engine including a second photoreceptor belt; and a controller operatively connected to the first and second printing engines, the controller configured to execute a method of controlling the synchronization of the first and second photoreceptor belts, the method comprising:

a) measuring a speed and phase of the first photoreceptor belt relative to a photoreceptor belt seam associated with the first photoreceptor belt;

b) controlling a speed and phase of the second photoreceptor belt to substantially equal the measured speed of the first photoreceptor belt and the phase adjusted to substantially equal the measured phase of the first photoreceptor belt plus an offset associated with the travel distance of a media sheet from the first printing engine to the second printing engine, wherein the speed and phase of the second photoreceptor belt is controlled while the second printing engine is not developing an image on the second photoreceptor belt;

c) developing one or more images on the second photoreceptor belt, the second photoreceptor belt controlled to operate at the measured speed of the first photoreceptor belt in step a); and d) maintaining a phase error of the second photoreceptor belt relative to the first photoreceptor belt as a function of a predetermined IOI registration tolerance associated with the second printing engine, the speed of the second photoreceptor being adjusted to the phase error while an image is being developed on the second photoreceptor belt.

10. The image processing system according to claim 9, step d) further comprising:

adjusting the speed of the second photoreceptor belt no more than once per revolution of the photoreceptor belt by an increment associated with an acceptable IOI registration error.

11. The image processing system according to claim 10, wherein the increment is in the range of 1/64 Hz-1/16 Hz.

12. The image processing system according to claim 10, step d) further comprising:

adjusting the speed of the second photoreceptor belt incrementally as a function of the phase error associated with the second photoreceptor belt, relative to the first photoreceptor belt.

13. The image processing system according to claim 12, step d) further comprising:

adjusting the speed of the second photoreceptor belt incrementally as a function of the phase error and derivative of the phase error associated with the second photoreceptor belt relative to the first photoreceptor belt.

14. The image processing system according to claim 13, step d) further comprising:

processing the phase error through a low pass filter.

15. The image processing system according to claim 9, step d) comprising:

d1) measuring a phase error of the second photoreceptor belt relative to the first photoreceptor belt;

d2) if the phase error is less than a negative threshold value, then decreasing the speed of the second photoreceptor belt by a predetermined increment associated with maintaining the predetermined IOI registration tolerance;

d3) if the phase error is greater than a positive threshold value, then increasing the speed of the second photoreceptor belt by the predetermined increment associated with maintaining the predetermined IOI registration tolerance; and d4) if the phase error is greater than or equal to the negative threshold value, and less than or equal to the positive threshold value, then maintaining the speed of the second photoreceptor belt at the measured speed of the first photoreceptor belt in step a).

16. The image processing system according to claim 15, step d) further comprising:

measuring or calculating the derivative of the phase error of the second photoreceptor belt;

determining an optimal speed of the second photoreceptor belt as a function of the measured speed of the first photoreceptor belt in step a) and the derivative of the phase error; and adjusting the steady state speed of the second photoreceptor belt to the optimal value, wherein for purposes of step d1)-d4), the optimal speed is treated as the measured speed of the first photoreceptor belt in step a).

17. A computer program product that when executed causes a controller to execute instructions to perform a method comprising:

a) measuring a speed and phase of the first photoreceptor belt relative to a photoreceptor belt seam associated with the first photoreceptor belt;

b) controlling a speed and phase of the second photoreceptor belt to substantially equal the measured speed of the first photoreceptor belt and the phase adjusted to substantially equal the measured phase of the first photoreceptor belt plus an offset associated with the travel distance of a media sheet from the first printing engine to the second printing engine, wherein the speed and phase of the second photoreceptor belt is controlled while the second printing engine is not developing an image on the second photoreceptor belt;

c) developing one or more images on the second photoreceptor belt, the second photoreceptor belt controlled to operate at the measured speed of the first photoreceptor belt in step a); and d) maintaining a phase error of the second photoreceptor belt relative to the first photoreceptor belt as a function of a predetermined IOI registration tolerance associated with the second printing engine, the speed of the second photoreceptor being adjusted to the phase error while an image is being developed on the second photoreceptor belt.

18. The computer program product according to claim 17, step d) further comprising:

adjusting the speed of the second photoreceptor belt no more than once per revolution of the photoreceptor belt by an increment associated with an acceptable IOI registration error.

19. The computer program product according to claim 18, wherein the increment is in the range of 1/64 Hz-1/16 Hz.

20. The computer program product according to claim 18, step d) further comprising:

adjusting the speed of the second photoreceptor belt incrementally as a function of the phase error associated with the second photoreceptor belt, relative to the first photoreceptor belt.

* * * * *